United States Patent [19]

Andrieu et al.

[11] 4,362,313

[45] Dec. 7, 1982

[54] TOE ABUTMENT MEMBER FOR A SKI BINDING

[75] Inventors: Louis Andrieu, Guerigny; Jean Bernard; Jean Beyl, both of Nevers; Daniel LeFaou, Varennes Vauzelles; Henri Peyre; Jacky Veniat, both of Nevers, all of France

[73] Assignee: Sté Look, Nievre, France

[21] Appl. No.: 200,978

[22] Filed: Oct. 27, 1980

[30] Foreign Application Priority Data

Nov. 13, 1979 [FR] France ..... 79 27894

[51] Int. Cl.[3] ..... A63C 9/22

[52] U.S. Cl. ..... 280/628

[58] Field of Search ..... 280/623–632

[56] References Cited

U.S. PATENT DOCUMENTS 3,709,510 1/1973 Gotz ..... 280/628

4,088,343 5/1978 Krob ..... 280/625

FOREIGN PATENT DOCUMENTS 2413915 8/1979 France .

*Primary Examiner*—Robert J. Spar

*Assistant Examiner*—Donald W. Underwood

*Attorney, Agent, or Firm*—Jordan B. Bierman; Linda G. Bierman

[57] ABSTRACT

The toe abutment member comprises a jaw unit pivotally mounted on the ski and consisting of two lateral arms adapted to cooperate with the front portion of the ski boot in order to maintain the boot in the axis of the ski, and a resilient device housed within the body of the abutment member for locking the arms in the boot-retaining position with a predetermined stiffness of release. The toe abutment member essentially comprises in addition a feeler member placed in contact with the front portion of the ski boot and adapted to cooperate with the resilient device to reduce the stiffness of release at the time of a forward-fall position and/or when an axial thrust is exerted on the ski boot. The jaw unit is mounted on the body for pivotal displacement about a transverse horizontal axis, and the feeler member is also mounted for rotation about a transverse horizontal axis so as to produce action on the resilient device by reducing its stiffness of release in the further event of a backward-fall position of the skier.

6 Claims, 10 Drawing Figures

TOE ABUTMENT MEMBER FOR A SKI BINDING

This invention relates to a toe abutment member for a ski binding.

Two difficulties are encountered in the operation of toe abutment members: the first difficulty arises at the time of disengagement caused by a complex fall in which a forward-fall movement is combined with a twisting movement of the skier. In such cases there is a considerable increase in general stiffness of release of the ski boot under torsional stress by reason of the appreciable increase in friction between the toe end of the boot and the ski, which is added to the inherent stiffness of release.

The second difficulty arises whenever an axial thrust is exerted on the toe abutment member. This thrust may appear under various circumstances, for example in the event of abrupt braking of the ski or of substantial flexural deformation of the ski which has a tendency to compress the ski boot between the toe abutment member and the heel-retaining member. In all these cases, lateral disengagement of the ski boot is impeded by the parasitic friction forces which develop between the ski boot and the toe abutment member.

In a known design of toe abutment member disclosed in French Pat. No. 2,413,915, the abutment member of a ski binding comprises a jaw unit constituted by two lateral arms which are intended to cooperate with the front portion of the ski boot in order to maintain this latter in the axis of the ski. Said jaw unit (or end-piece) is pivoted about a horizontal axis on a body which is in turn pivoted about a vertical axis, said vertical axis being materialized by a pivot which is attached to the ski. The pivot has a portion in the form of a cam against which is applied a piston controlled by a spring mounted within the body, thus having a tendency to secure the body elastically against rotational displacement about the pivot.

The piston is slidably mounted within the body and carries a follower member applied against two ramps which are rigidly fixed to the end-piece. In the event of a fall in the backward direction, the end-piece consequently pivots about the horizontal axis whilst the follower member and the piston move away from the cam, thereby reducing the stiffness of release of the ski binding.

However, an abutment member of this type does not make it possible to reduce the stiffness of the resilient trip mechanism in the event of a forward fall.

The aim of the invention is to provide a toe abutment member which is so arranged as to be capable of reducing the stiffness of the trip mechanism of said abutment member both in the event of a forward fall and in the event of a backward fall.

To this end and in accordance with the invention, the abutment member comprises a feeler member which is adapted to be in contact with the front portion or toe end of the ski boot and to cooperate with the resilient device in order to reduce the stiffness of release of this latter when the skier is in a forward-fall position and/or when an axial thrust is exerted on the ski boot. The jaw unit is pivotally mounted on the body about a transverse horizontal axis and the feeler member is also rotatably mounted on a transverse horizontal axis in order to be capable of producing action on the resilient device by reducing its stiffness of release, also in the event of a backward-fall position of the skier.

In one embodiment of the invention, the feeler member is constituted by an elbowed lever, that face of said lever which is directed towards the ski boot being profiled in order to cooperate with said boot and the other face of said lever being applied against at least one rod and preferably two rods slidably mounted within the body and interposed between the feeler member and the resilient arm-retaining device. The feeler member also has an inwardly curved surface in the form of a ramp, there being applied against said ramp a follower member which is rigidly fixed to the boot-retaining jaw unit.

Under these conditions, when the skier is in a backward-fall position, lifting of the jaw unit produces a pivotal displacement of the feeler member, with the result that said feeler member initiates a sliding displacement of the rods within the body and said rods cause the piston of the resilient device to move away from the pivot or at least reduce the force with which said piston is applied against the cam of the pivot.

The abutment member in accordance with the invention therefore provides additional safety for the skier by facilitating disengagement of the ski boot under torsional stress both in the event of a backward fall and in the event of a forward fall.

In accordance with one distinctive feature of the invention, the follower member which is applied against the ramp formed on the feeler member is constituted for example by a pin mounted transversely on a stirrup-piece which is adapted to carry the lateral retaining arms and is pivoted to the body about a horizontal axis, said pin being positioned at a level above the ski which is higher than the level of the axis of pivotal motion of the feeler member.

In consequence, when the ski boot is not engaged in the binding, the feeler member is maintained in position by the pin which is carried by the stirrup-piece.

Other features and advantages of the invention will be more apparent to those skilled in the art upon consideration of the following description and accompanying drawings in which two embodiments of the abutment member in accordance with the invention are shown by way of example and not in any limiting sense, and in which.

Figure 1:
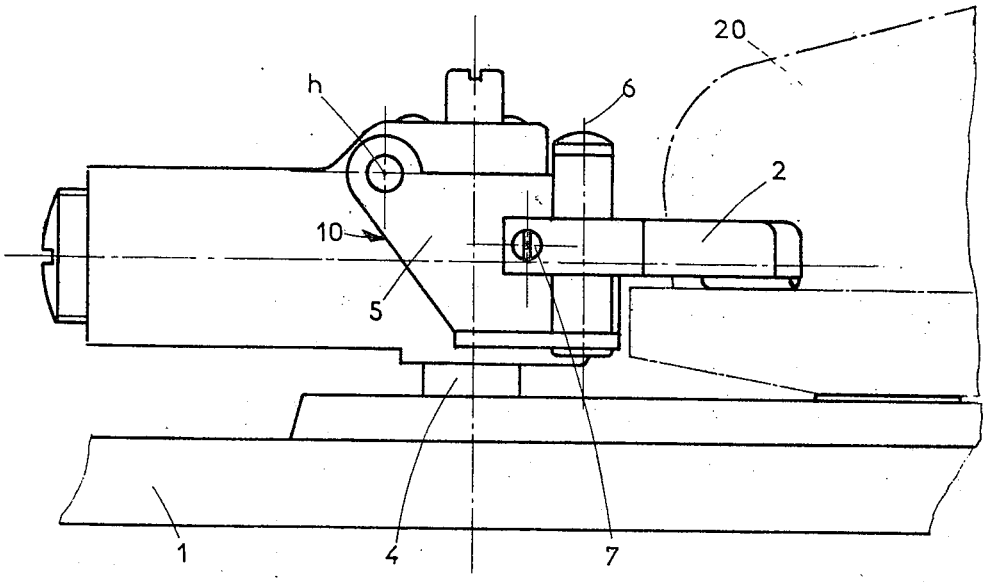
FIG. 1 is a side view of a first embodiment of the toe abutment member which is mounted on the ski as shown, the ski boot having been engaged in the abutment member.
Figure 2:
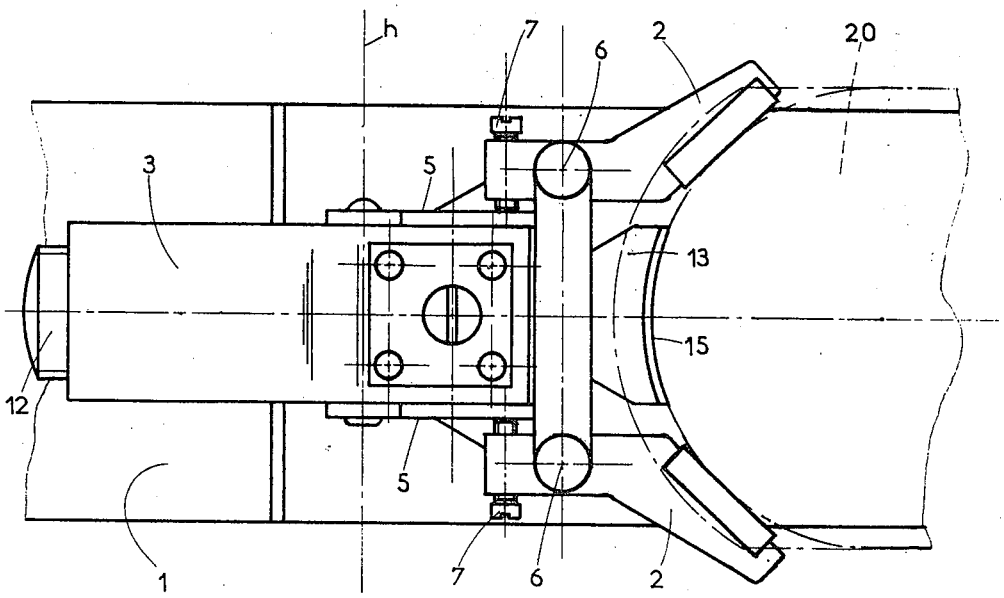
FIG. 2 is a top view of the abutment member of FIG. 1.
Figure 3:
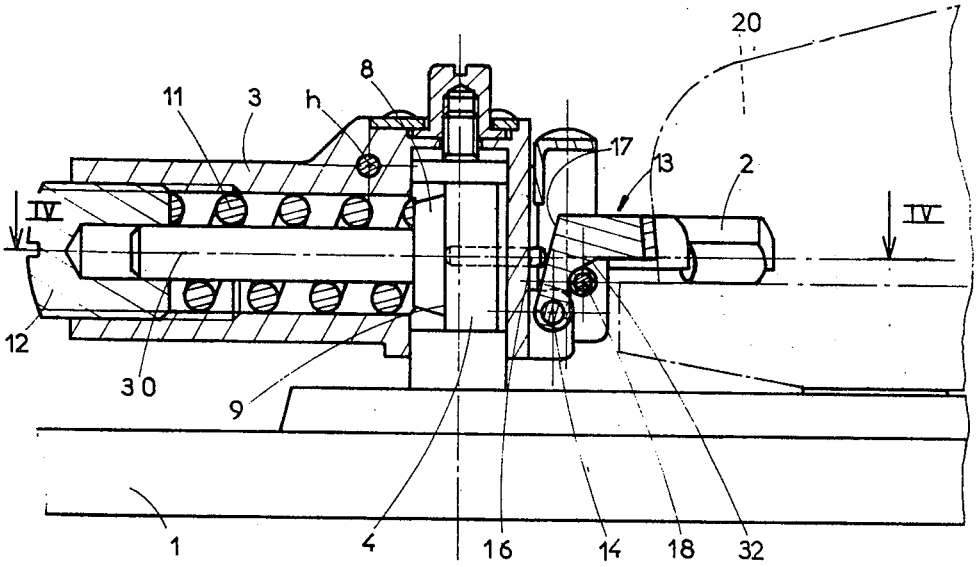
FIG. 3 is a longitudinal sectional view taken along line III—III of FIG. 4 of the abutment member of FIGS. 1 and 2.
Figure 4:
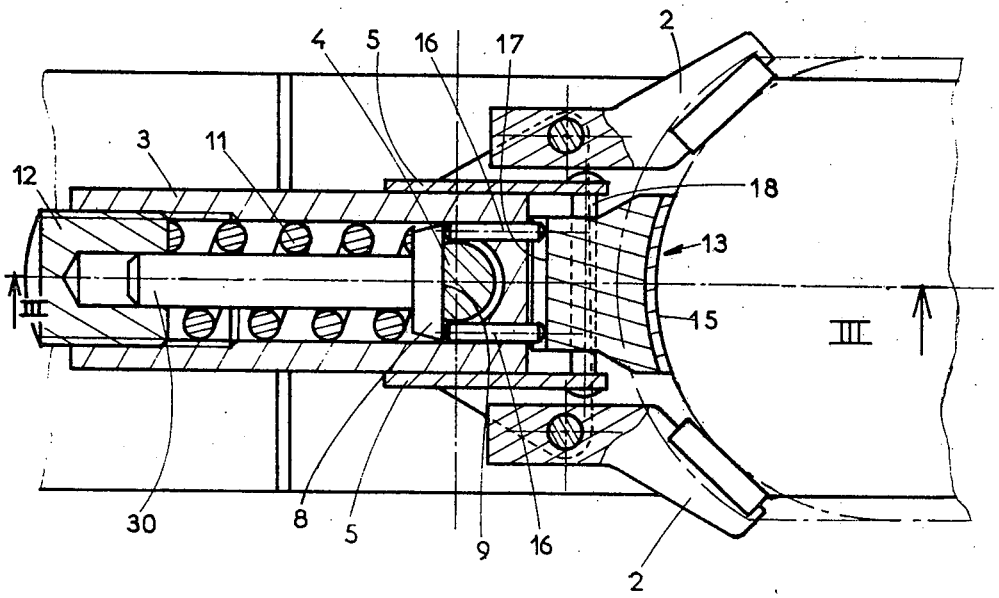
FIG. 4 is a sectional top view taken along line IV—IV of FIG. 3.

Referring to FIGS. 1 to 4, there is shown a toe abutment member for a ski binding; said abutment member is mounted on a ski 1 and has a jaw unit constituted by two lateral arms 2 which are intended to cooperate with the front portion of the ski boot 20 in order to maintain this latter in the axis of the ski 1, and a body 3 pivotally mounted on a pivot 4 which is fixed vertically on the ski 1; the arms 2 are carried by a stirrup-piece 10 constituted by two lateral cheeks 5 which are rotatably mounted on the body 3 about a horizontal axis h.

The arms 2 which constitute the boot-retaining jaw unit are capable of pivotal displacement with respect to the cheeks 5 about vertical axes 6 in order to permit adaptation to the different particular shapes of ski boots, the angular position of the arms 2 being adjustable by means of screws 7 which are applied against the cheeks 5.

The abutment member also comprises a resilient device which is housed within the body 3 and ensures that the arms 2 of the jaw unit are locked in a position of retention of the ski boot 20 with a predetermined stiffness of release. This resilient device comprises a piston 8 provided with a piston rod 30 and applied resiliently against a cam 9 consisting of a flat surface formed on the stationary pivot 4 at the front end of the ski. The piston 8 is normally maintained applied against said cam by a spring 11 which is coaxial with the piston-rod 30 and bears on an adjusting plug 12 which is screwed into the body 3.

The abutment member further comprises a feeler member 13 which is adapted to be in contact with the front portion of the ski boot 20 and to cooperate with the resilient device in such a manner as to reduce the stiffness of release of this latter at the time of a forward-fall position of the skier and/or of an axial thrust exerted by the ski boot.

In accordance with the invention, the feeler member 13 is rotatably mounted on a cross-pin 14 in such a manner as to be capable of producing action on the resilient device and of reducing its stiffness of release also in the event of a backward-fall position of the skier.

To this end, the feeler member 13 is constituted by an elbowed lever, the lever face 15 which is directed towards the ski boot 20 being profiled so as to provide a concave surface which is adapted to cooperate with said boot. That face 17 of the feeler member which is directed towards the front end of the ski is applied against the ends of two rods 16 which are slidably mounted within the body 3 on each side of the pivot 4. Said rods 16 are thus interposed between the feeler member 13 placed between the lateral arms 2 and the piston 8 which maintains the abutment member in its normal position.

The cross-pin 14 on which the follower member 13 is pivotally mounted is supported at both ends by the body 3. Furthermore, the feeler lever 13 is provided with a ramp 32 on the side which is directed towards the ski boot 20 and a follower member which is rigidly fixed to the jaw unit is applied against said ramp. In the example shown in the drawings, said follower member is constituted by a cross-pin 18, the ends of which are secured to the lateral cheeks 5 of the stirrup-piece 10. Said feeler member is preferably provided with an anti-friction roller (in order to limit friction forces between the cross-pin follower 18 and the ramp 32).

The toe abutment member which has just been described operates as follows.

Figure 5:
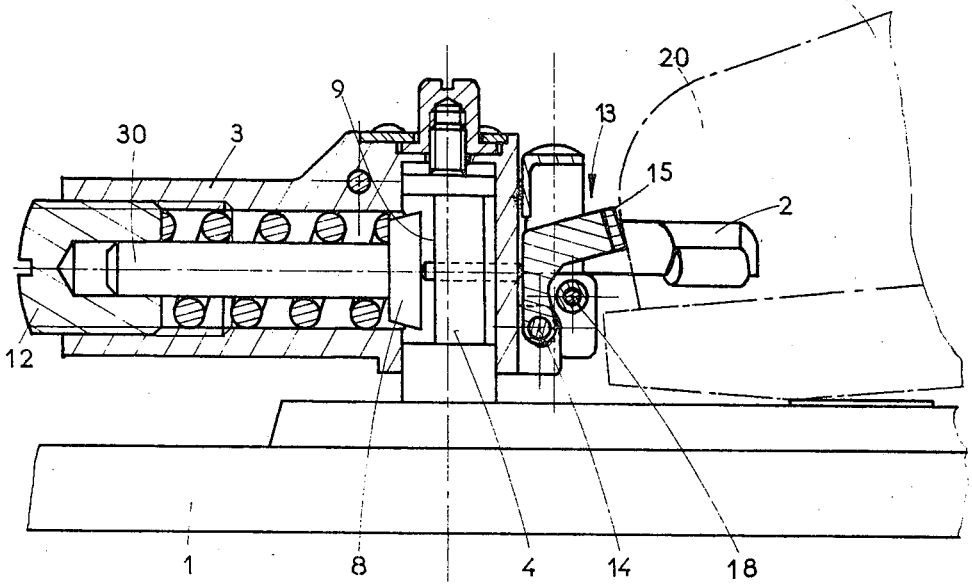
FIG. 5 is a view which is similar to FIG. 3 and shows a forward fall.

In the forward-fall position (shown in FIG. 5), the ski boot 20 carries out a movement of pivotal displacement in the direction of the arrow AV and the front portion of the boot thrusts back the feeler member 13 which pivots about the cross-pin 14 towards the piston 8. The lever 13 therefore exerts a thrust on the rods 16 which accordingly slide back within their recesses of the body 3 and apply on the piston 8 a force which acts in opposition to the restoring force of the spring 11. If the thrust transmitted by the feeler member 13 is of higher value than the opposing force of the spring 11, the piston 8 moves away from the flat surface 9 as shown in FIG. 5.

The inherent stiffness of release of the abutment member under torsional stress as a result of the action produced by the piston 8 on the cam 9 is therefore zero; resistance to release is solely due in this case to friction forces exerted between the boot and the ski and between the boot and the binding.

If the thrust transmitted by the feeler member 13 is of lower value than the restoring force exerted by the spring 11 on the piston 8, said piston remains applied against the cam 9 but with lower force, thereby reducing the stiffness of release.

Figure 6:
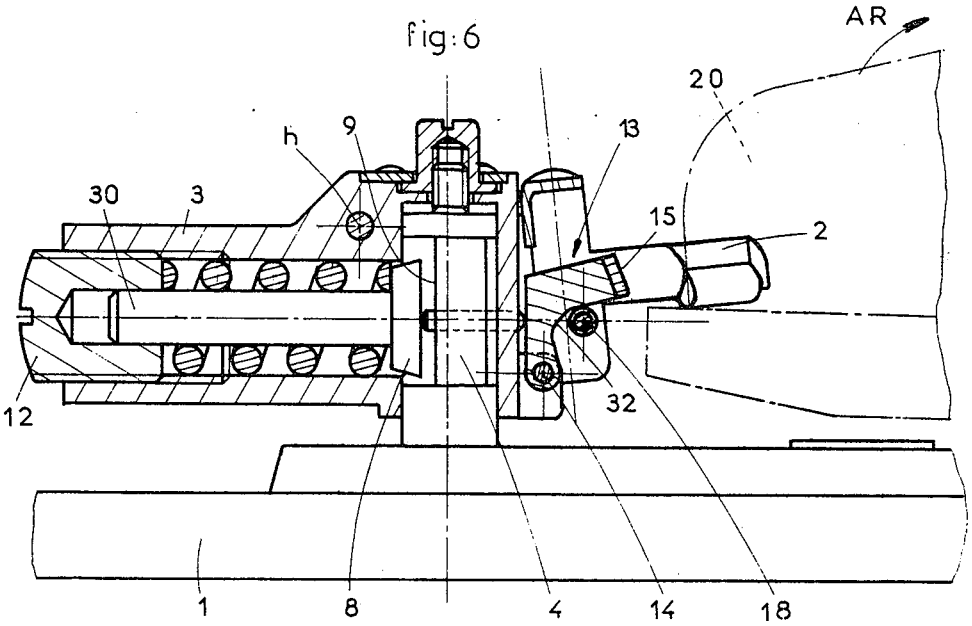
FIG. 6 is a view which is similar to FIG. 5 and shows a backward fall.
Figure 7:
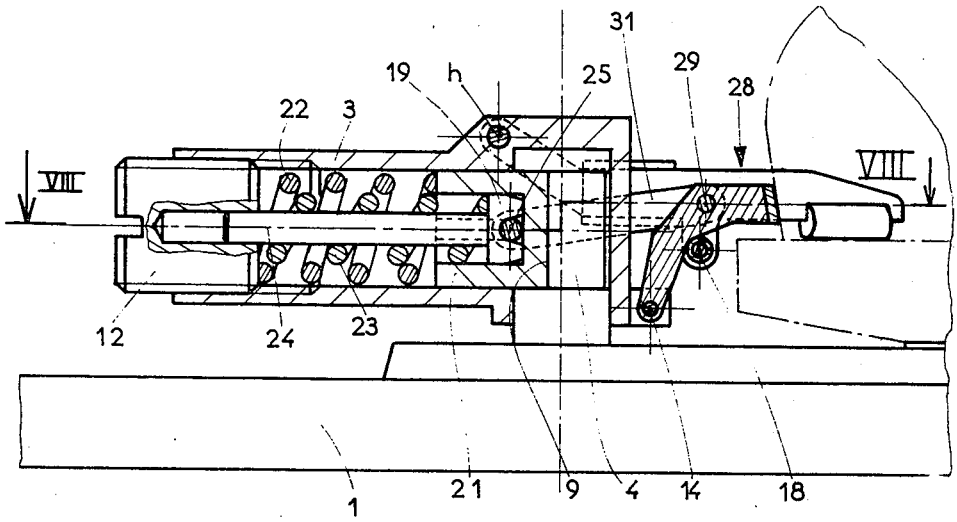
FIG. 7 is a longitudinal sectional view taken along line VII—VII of FIG. 8 and showing a second embodiment of the abutment member in accordance with the invention.
Figure 8:
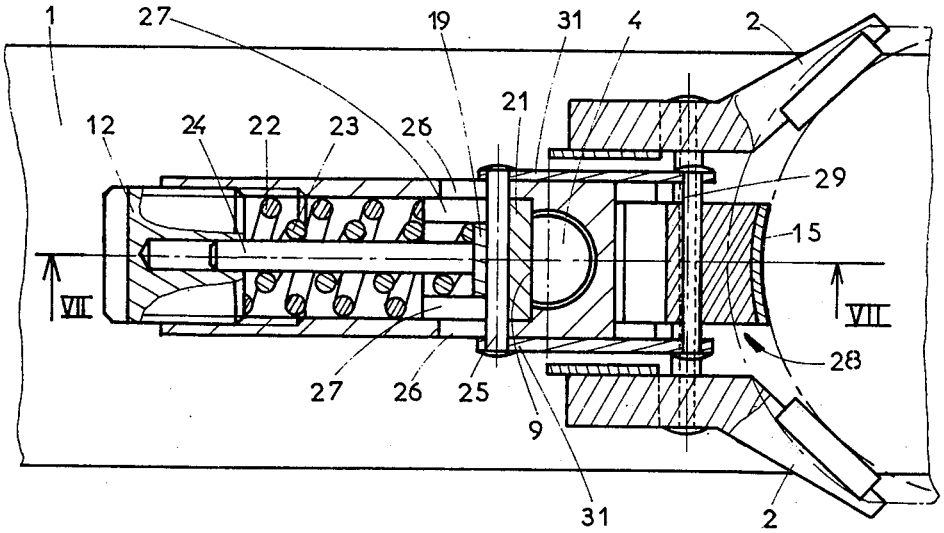
FIG. 8 is a sectional top view taken along line VIII—VIII of FIG. 7.

In the event of a backward fall, the ski boot 20 undergoes an upward and rearward displacement (as indicated by the arrow AR in FIG. 6) and its front portion moves away from the profiled face 15 of the feeler member 13. However, the boot lifts the jaw unit formed by the arms 2, with the result that the jaw unit and the stirrup-piece 10 undergo a pivotal displacement about the horizontal axis h. The pin 18 which is rigidly fixed to the stirrup-piece 10 pivots with this latter and produces action on the ramp 32 so as to cause the lever 13 to undergo a pivotal displacement as in the previous instance and as shown in FIG. 6. In consequence, the feeler member 13 exerts a longitudinal thrust on the rods 16 which slide within the body 3 and apply on the piston 8 a force which is in opposition to the force of the restoring spring 11. If the force exerted on the jaw unit by the ski boot 20 is sufficient to produce a thrust on the piston 8 which is higher than its restoring force, the piston moves away from the flat surface 9 as illustrated in FIG. 6. In the contrary case, the stiffness of the trip mechanism is simply reduced.

The embodiment illustrated in FIGS. 7 to 10 differs from the preceding embodiment in that the resilient restoring device is provided with a second piston 19 slidably mounted within a piston 21 which is normally applied on the cam 9 by a restoring spring 22. The second piston 19 therefore has a surface area which is smaller than that of the piston 21 and is urged elastically against this latter by a spring 23 placed within the interior of the spring 22. As in the previous embodiment, these two springs are applied against the threaded plug 12 which serves to adjust the stiffness of the mechanism and within which is slidably fitted the end of the rod 24 of the piston 19.

Said piston 19 is provided with a bore in which is engaged a transverse rod 25, said rod being consequently interposed between the piston 19 and the piston 21, the ends of the rod being adapted to pass through lateral slots 27 and 26 respectively of the piston 21 and the body 3. Said slots are elongated in the longitudinal direction in order to permit relative displacement of the rod 25 in this direction and away from the piston 21. The feeler member 28 is provided with a transverse rod 29, the ends of which are joined to those of the rod 25 by means of crank-arms 31.

The abutment member described in the foregoing operates as follows.

Figure 9:
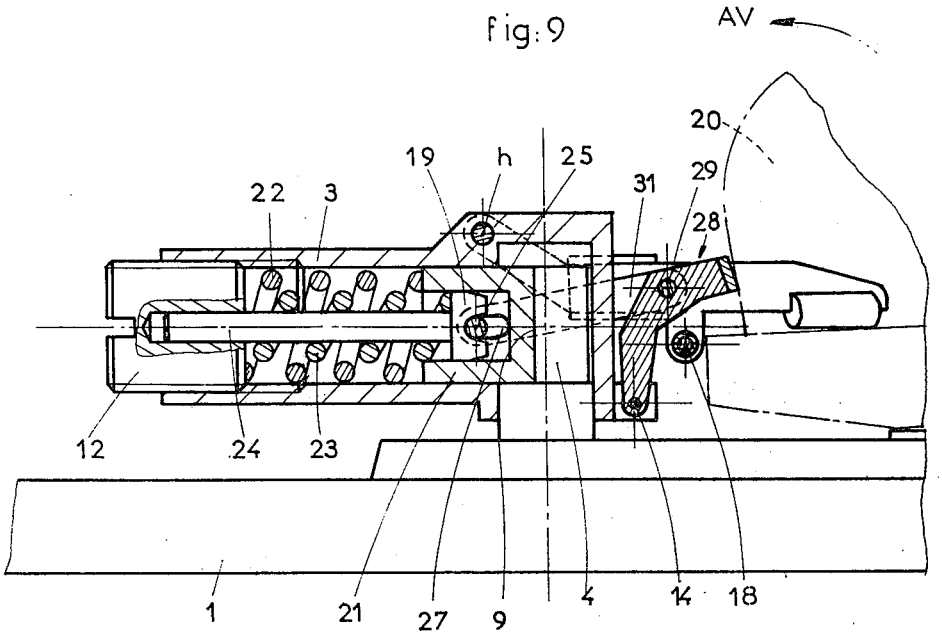
FIG. 9 is a view which is similar to FIG. 7 and shows a forward fall.

In the event of a forward fall (as shown in FIG. 9), the ski boot 20 exerts on the feeler member 28 a thrust which is transmitted to the piston 19 by the frame constituted by the rods 29, 25 and the crank-arms 31. If the thrust is of higher value than the restoring force of the spring 23, the rod 25 moves away from the piston 21 (which nevertheless remains applied against the flat surface 9), the ends of the rod 25 slide within the elongated slots 26, 27 and move the piston 19 away from the piston 21.

Under these conditions, the stiffness of the trip mechanism is reduced but not brought back to zero since the piston 21 remains applied against the pivot 4 by its restoring spring 22.

Figure 10:
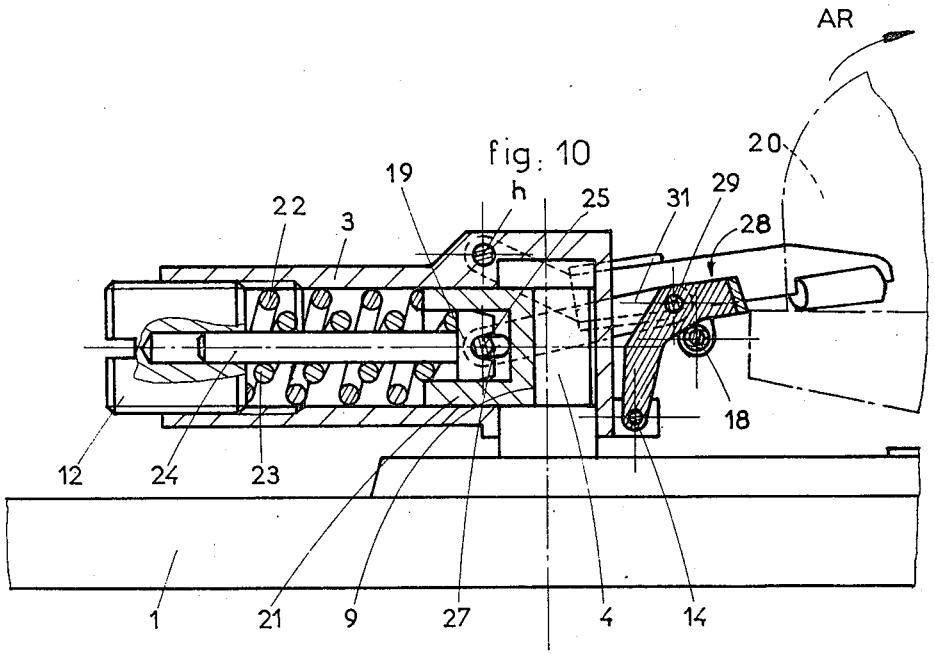
FIG. 10 is a view which is similar to FIG. 9 and shows a backward fall.

In the event of a backward fall (as shown in FIG. 10), the ski boot 20 lifts the lateral arms 2. In consequence, the cross-pin 18 is lifted and causes pivotal displacement of the feeler member 28 towards the stationary pivot 4, with the result that the thrust transmitted by the crank-arms 31 to the rod 25 moves the piston 19 away from the piston 21 as in the previous instance if said thrust exceeds the restoring force of the spring 23.

Should this not be the case, the piston 19 and the rod 25 remain applied against the piston 21 but the stiffness of the trip mechanism is reduced.

This embodiment offers the advantage of preventing the "floating" condition which arises within the abutment member when there is an excessive accumulation of snow beneath the ski boot. In this case the boot is in fact raised to a level above its normal position, with the result that the retaining end-piece or jaw unit is also raised as in the position shown in FIG. 6, and is then liable to hold the piston 8 permanently at a distance from the flat surface 9. In the second embodiment, only the inner piston 19 is thrust back, with the result that there always remains a certain resistance to release under the action produced by the outer piston 21 on the flat surface 9.

The invention is not limited to the embodiment hereinabove described and may extend to alternative forms of construction. Thus it follows that the feeler member can be arranged so as to be adapted to the sole of the ski boot rather than to the upper of said boot.

What is claimed is:

1. A toe abutment member for a ski binding, comprising:

a jaw unit constituted by two lateral arms adapted to cooperate with the front portion of the ski boot in order to maintain said boot in the axis of the ski, said jaw unit being carried by a body and said body being pivotally mounted on a pivot which is intended to be attached vertically to said ski;

a resilient device housed within the body for locking the arms in the boot-retaining position with a predetermined stiffness of release, wherein said toe abutment member comprises a feeler member adapted to be in contact with the front portion of the ski boot and to cooperate with the resilient device so as to reduce the stiffness of release of said device at the time of a forward-fall position of the skier and/or of an axial thrust exerted by the ski boot, and wherein the jaw unit is mounted on the body for pivotal displacement about a transverse horizontal axis and the feeler member is also mounted so as to be capable of rotation about a transverse horizontal axis and consequently of producing action on the resilient device by reducing its stiffness of release in the further event of a backward-fall position of the skier.

2. A toe abutment member according to claim 1, wherein the feeler member is constituted by an elbowed lever, that face of said lever which is directed towards the boot being profiled so as to cooperate with said boot whilst the other face is applied against at least one rod and preferably two rods slidably mounted within the body and interposed between the feeler member and the resilient arm-retaining device.

3. A toe abutment member according to claim 1, wherein the feeler member has an inwardly curved surface in the form of a ramp, a follower member which is rigidly fixed to the jaw unit being applied against said ramp.

4. A toe abutment member according to claim 3, wherein the follower member is constituted by a cross-pin carried by the jaw unit and preferably fitted with an anti-friction roller which is capable of rolling against the ramp.

5. A toe abutment member according to claim 1, wherein the resilient device for retaining the arms in their normal position comprises a first piston slidably mounted within the body and applied against a cam formed on the stationary pivot by a first resilient member housed within said body, wherein said resilient device is provided with a second piston having a smaller surface area than that of the first piston and slidably mounted within said first piston, and with a second resilient member which urges the second piston against the first piston, and wherein said abutment member comprises means for causing the feeler member to cooperate with the second piston in order to move said second piston away from said first piston while correlatively reducing the stiffness of release in the event of either a forward fall or a backward fall.

6. A toe abutment member according to claim 5, wherein the means aforesaid comprise a first rod disposed transversely within the feeler member, the ends of said rod being connected to the ends of a second rod which is positioned transversely between the two pistons so as to constitute a frame rigidly fixed to the feeler member, suitable slots being formed in the body and in the first piston in order to permit reciprocating movements of the second rod and of the second piston with respect to the first piston as a result of movements of rotation of the feeler member.

* * * * *